US006510919B1

(12) United States Patent
Roy et al.

(10) Patent No.: US 6,510,919 B1
(45) Date of Patent: Jan. 28, 2003

(54) FACING SYSTEM FOR A FLAT PANEL RADIATOR

(75) Inventors: Kenneth P. Roy, Holtwood, PA (US); Peter Oleske, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 09/651,905

(22) Filed: Aug. 30, 2000

(51) Int. Cl.[7] ..... H04R 7/00
(52) U.S. Cl. ..... 181/173; 181/167; 381/423
(58) Field of Search ..... 181/167, 168, 181/169, 170, 171, 173; 381/152, 423, 426, 431

(56) References Cited

U.S. PATENT DOCUMENTS

| | | | | |
|---|---|---|---|---|
| 1,630,011 | A | | 5/1927 | Hopkins |
| 3,108,653 | A | | 10/1963 | Valldeperas |
| 3,858,679 | A | | 1/1975 | Askins |
| 3,941,638 | A | | 3/1976 | Horky et al. |
| 4,173,267 | A | | 11/1979 | Chatani |
| 4,296,280 | A | | 10/1981 | Richie |
| 4,359,133 | A | | 11/1982 | Krolak |
| 4,529,059 | A | | 7/1985 | Price |
| 4,898,260 | A | | 2/1990 | Fang |
| 4,903,300 | A | | 2/1990 | Polk |
| 4,923,032 | A | | 5/1990 | Nuernberger |
| 4,924,963 | A | | 5/1990 | Polk |
| 4,928,312 | A | * | 5/1990 | Hill ..... 381/152 |
| 5,025,474 | A | | 6/1991 | Tanaka et al. |
| 5,082,083 | A | | 1/1992 | Draffen |
| 5,113,968 | A | | 5/1992 | Lemmon |
| 5,322,979 | A | | 6/1994 | Cassity et al. |
| 5,331,119 | A | | 7/1994 | Leger et al. |
| 5,400,413 | A | | 3/1995 | Kindel |
| 5,412,162 | A | | 5/1995 | Kindel |
| 5,793,877 | A | | 8/1998 | Tagg |
| 5,872,855 | A | | 2/1999 | Porrazzo et al. |
| 5,952,619 | A | | 9/1999 | Kantor et al. |
| 6,015,025 | A | | 1/2000 | McGrath et al. |
| 6,164,408 | A | | 12/2000 | Lamm et al. |
| 6,215,881 | B1 | * | 4/2001 | Azima et al. ..... 381/152 |

* cited by examiner

*Primary Examiner*—Khanh Dang
(74) *Attorney, Agent, or Firm*—Womble Carlyle Sandridge & Rice, PLLC

(57) ABSTRACT

A flat panel sound radiator system for installation in a suspended ceiling is disclosed. The system is capable of concealing a modular sound radiator so that it appears substantially the same as surrounding ceiling panels. In this way the monolithic appearance of the ceiling is not interrupted. The assembly comprises a frame and a radiating panel resting within the frame and an acoustic facing covering the panel that is substantially indistinguishable from surrounding ceiling panels. Additionally disclosed is a ceiling system including a grid, a plurality of ceiling panels and an acoustical radiator having an acoustical visually matched exposed layer.

24 Claims, 2 Drawing Sheets

FACING SYSTEM FOR A FLAT PANEL RADIATOR

FIELD OF INVENTION

The present invention generally relates to speakers and more particularly to ceiling speakers.

BACKGROUND

As the service sector of the economy grows, more and more workers find themselves in offices rather than in manufacturing facilities. The need for flexible, reconfigurable space has resulted in open plan workspaces, large rooms with reduced height, moveable partitions and suspended ceiling systems. Workstation density is also increasing, with more workers occupying a given physical space. Additionally, speakerphones, conferencing technologies, and multimedia computers with large, sound reflecting screens and voice input tend to increase the noise level of the workplace.

In response to increased noise within the workplace, suspended ceilings having acoustical ceiling panels, have been developed to absorb and abate extraneous noise within a confined space. The modular design of such panels allows for ease of installation and ease in office space reconfiguration. Building planners often specify modular ceiling panels as a standard system within their designs. Ceiling panels can both enhance the work environment by providing acoustic sound absorption and attenuation, and by providing a pleasant monolithic visual appearance. Thus, there has been an increased emphasis on specifying ceiling systems with high acoustic absorption and pleasant visual appearance.

Loudspeakers often are used to provide sound in a workspace. Such sounds typically may include paging messages, music, and background masking which reduces the effect of unwanted noise from infrastructure systems such as ventilation systems, and mask speech noise allowing for greater speech privacy.

Building planners prefer to specify ceiling systems that are substantially monolithic in structure and design. Such ceiling systems provide a pleasant visual appearance to the person viewing the ceiling from below. Loudspeakers often are required in office spaces where ceilings are formed of ceiling panels. Preferably, the installation of loudspeaker systems within a suspended ceiling does not interrupt the desired monolithic design of the ceiling.

Unfortunately, current loudspeaker systems for installation in suspended ceilings are unable to provide a modular design that can integrate both functionally and visually into the ceiling system. For example, many speaker systems, when installed, protrude below the plane of the ceiling panels, thus interrupting the planar surface of the ceiling. Additionally, speaker systems can be installed by cutting out a portion of a panel and installing a speaker with a round perforated grill within the opening. Such a speaker grill clearly interrupts the monolithic appearance of the ceiling and is considered unsightly by some.

What is needed is a speaker assembly system that is visually compatible with a monolithic suspended ceiling tile installation.

SUMMARY

The present invention provides a flat panel sound radiator assembly system that is substantially visually equivalent to the monolithic look of surrounding ceiling tiles in a suspended ceiling. The assembly is modular in design and provides an acoustic facing that is substantially visually indistinguishable from surrounding ceiling panels.

Briefly described, the flat panel sound radiator assembly comprises a frame and a radiating panel resting within the frame. The frame includes a bridge element fitted to the frame. The radiating panel has both a backing and facing side and an acoustic transducer mounted to the backing side of the radiating panel. An acoustic facing concealing the facing side of the radiating panel is applied, wherein the acoustic facing is substantially visually indistinguishable from surrounding ceiling panels. The flat panel sound radiator assembly further comprises part of a monolithic suspended ceiling structure, wherein the assembly is virtually visually indistinguishable from the surrounding ceiling tiles of the suspended ceiling.

A further embodiment of the present invention includes a ceiling system comprising a plurality of ceiling panels having an exposed surface and a flat panel sound radiator. The flat panel sound radiator comprises a support and an acoustical visually matched exposed layer. The exposed layer of the radiator is substantially visually indistinguishable from the exposed surfaces of the ceiling panels.

The flat panel sound radiator assembly and system conceals the modular speaker so that it appears substantially the same as the ceiling panels that surround it. In this way, the monolithic appearance of the ceiling is not interrupted.

DETAILED DESCRIPTION

The present invention generally relates to a modular flat panel sound radiator assembly for installation in a suspended ceiling that is compatible with and virtually visually indistinguishable from surrounding ceiling tiles of the ceiling system. The modular flat panel sound radiator comprises a ceiling assembly sized to fit within a ceiling support grid and preferably within the same plane as the surrounding ceiling tiles. The flat panel sound radiator assembly comprises a substantially indistinguishable part of the monolithic ceiling tile system.

The flat panel sound radiator assembly includes a frame resting within the ceiling support grid and a radiating panel set within the frame. A bridge element is added to the frame to support a portion of the electrical components that are operatively connected to the backing side of the radiating panel. An acoustic facing is added to conceal the facing side of the radiating panel, and the acoustic facing is substantially visually indistinguishable from the surrounding ceiling panels.

Additionally, a ceiling system comprising a flat panel sound radiator that is substantially indistinguishable from the surrounding ceiling panels is disclosed. The flat panel radiator is more fully described in a co-pending and commonly assigned U.S. Patent Application entitled, "Flat Panel Radiator and Assembly System" having U.S. patent application No. 09/627,706 which is incorporated by reference as though set forth in fall herein.

The ceiling system essentially comprises a plurality of ceiling panels each having an exposed surface of a substantially similar pattern as the other ceiling panels. In greater detail, the system comprises an acoustical radiator having a support and an acoustically transparent and visually matched exposed layer. The visually matched exposed layer is substantially indistinguishable from the exposed surfaces of surrounding ceiling panels so that the ceiling appearance remains significantly monolithic in both structure and design. The system integrates both functionally and visually the acoustical radiator into the ceiling system.

Figure 1:
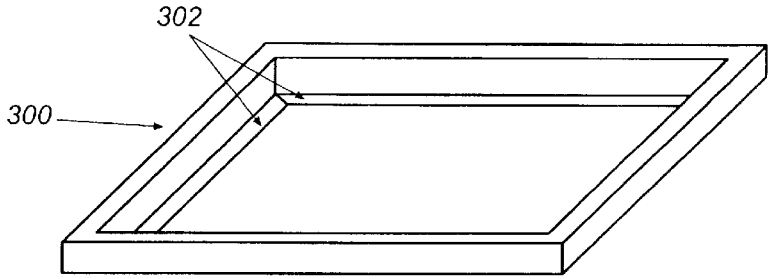
FIG. 1 is an isometric view of the frame element and attached extrusion element.

In one embodiment, the frame 300 is illustrated in FIG. 1 as being rectangular, which is the standard shape of most grid openings in a ceiling panel system. While the frame 300 is shown as rectangular, the frame 300 may take any shape so long as it fits within the grid of a suspended ceiling. The frame 300 is fitted within the standard grid opening of a ceiling system so that the flat panel sound radiator can easily be installed and, when installed, forms part of the monolithic structure of the ceiling system. To that end, the frame 300 is sized to fit between and span the grid elements 100 (shown in FIG. 4 and FIG. 5) and is supported by overlapping the lower portion of the grid element 100 in much the same way as a standard ceiling tile. The frame is of suitable strength to support a woven, or non-woven glass fiber, cloth, paper or plastic facing. An extrusion 302 can be secured to the frame element 300 and is of suitable strength to support a panel.

Figure 2:
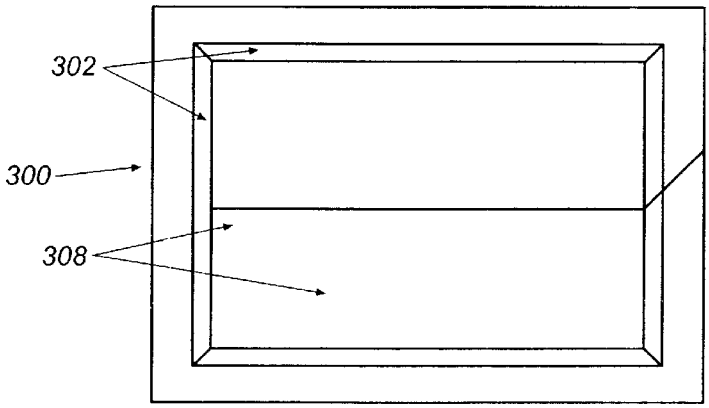
FIG. 2 is a bottom view of the acoustic facing showing a rectangular frame, a partial view of the facing and exposed frame element.

In FIG. 2, the frame 300 is illustrated with the attached acoustical facing 308. The frame 300 fits between the grid elements 100 and a suitable adhesive is applied to it to provide an attaching surface for the facing 308. An extrusion 302 may be secured to the frame element 300, upon which a suitable adhesive may also be applied to provide an attaching surface for the facing 308. Other suitable mechanisms for attaching the facing 308 to the frame 300 may be used, such as mechanical fasteners. The attachment mechanism is preferably selected from those mechanisms capable of preventing the facing 308 from sagging.

The decorative acoustic facing 308 may be a semitransparent covering applied to the frame element 300. The acoustic facing 308 may be composed of glass fiber, cotton, imaged paper, imaged polypropylene or any woven, non-woven, or pressed material with sufficient acoustic transparency to enable efficient transfer of sound from a flat panel sound radiator or a standard speaker mounted in the frame element 300. The facing 308 can be painted, stenciled or otherwise marked with any color or pattern so as to be substantially visually indistinguishable from surrounding ceiling panels.

Figure 3:
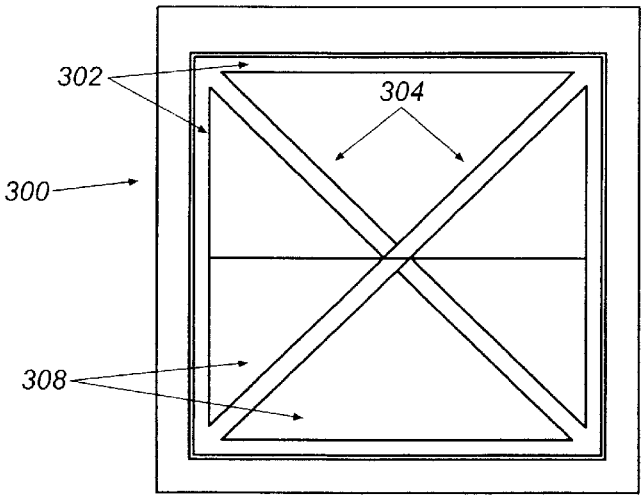
FIG. 3 is a bottom view of the facing side of the acoustical facing further illustrating the facing support members.

The embodiment illustrated in FIG. 3 includes a facing support 304 attached to the frame element 300, which fits between the grid elements 100. The facing support 304 further stabilizes the facing 308 by preventing the facing 308 from sagging. The facing 308 is fastened to the frame element 300, extrusion 302, and facing support member 304 with a suitable adhesive or other fastening method and spans the opening defined by the frame element 300. The facing 308 can be painted, stenciled or otherwise marked with any color or pattern so as to be visually indistinguishable from surrounding ceiling panels in the suspended ceiling.

Figure 4:
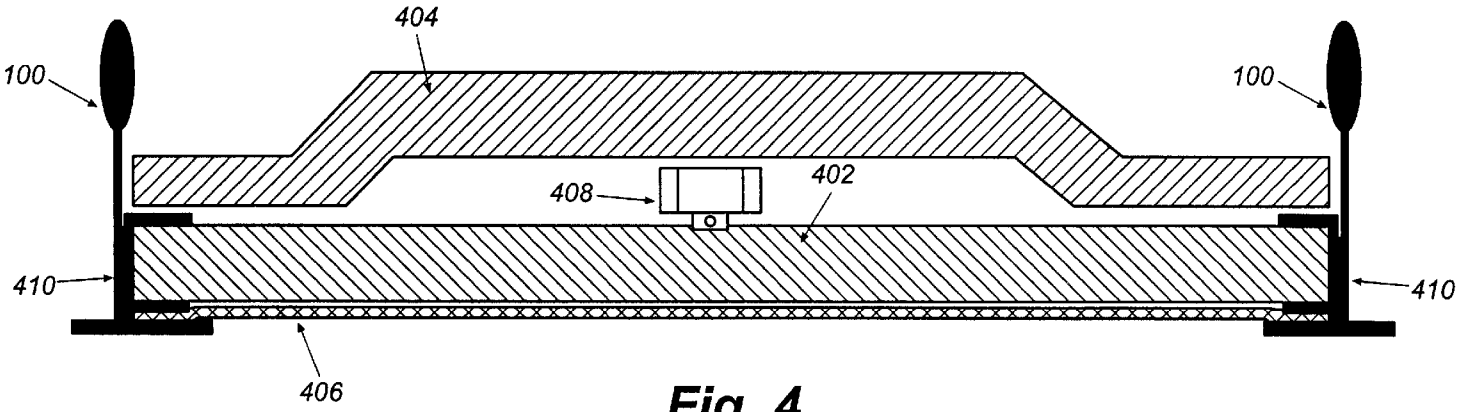
FIG. 4 is a cutaway side view of the flat panel sound radiator illustrating an acoustic facing applied directly to a radiating panel.

The embodiment illustrated in FIG. 4 includes a flat panel sound radiator within the ceiling grid support elements 100 surrounding the location of installation. The grid elements 100 comprise part of the supporting structure for the suspended ceiling support system. The supporting grid elements are arranged in roughly the same size as the panel to be installed. Sufficient space is provided between the grid elements to allow the panel to be inserted and rest between them without falling through.

An acoustic transducer assembly 408 provides mechanical power to the radiating panel 402 and is mounted on the back of the radiator panel 402. The bridge element 404 is attached to the frame element 410, and provides a mounting structure for the electrical components. The frame element 410 is centered between the ceiling support elements 100, and contains the radiating panel 402 that is attached to an acoustic transducer(s) 408. The frame element 410 provides support for the radiating panel 402. Additionally, multiple exciters or transducers 408 can be used.

The acoustic facing 406 is a decorative covering that is applied directly to the radiating panel 402. The decorative acoustic facing 406 can be formed of woven glass fiber, woven cotton, imaged paper, imaged polypropylene or any woven or pressed material with sufficiently low mass and internal damping to enable efficient transfer of sound from flat panel speaker elements 402 and 408 mounted in the frame element 410. Additionally, any facing material with high airflow resistance characteristics, which could not normally be used as an acoustic facing, are readily applicable in this configuration. The facing material is fastened to the radiating panel 402 with a suitable adhesive and spans the opening defined by the grid support elements 100. The facing material can be painted, stenciled or otherwise marked with any color or pattern so as to be substantially visually indistinguishable from other ceiling panels in the same plane.

Figure 5:
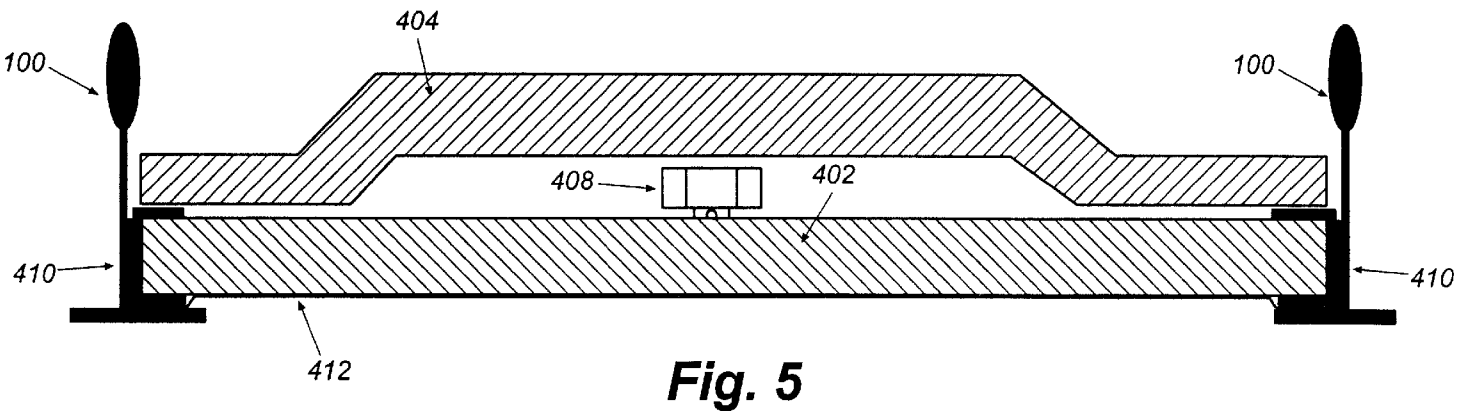
FIG. 5 is a cutaway side view of the flat panel sound radiator illustrating an acoustic surface applied as a pigmented coating to the radiating panel.

In a further embodiment, as illustrated in FIG. 5, a decorative pattern is applied onto the surface of the flat panel speaker using an organic coating, such as paint.

While Applicants have set forth embodiments as illustrated and described above, it is recognized that variations may be made with respect to disclosed embodiments. Therefore, while the invention has been disclosed in various forms, it will be obvious to those skilled in the art that many additions, deletions and modifications can be made without departing from the spirit and scope of this invention. Thus, no undue limits should be imposed except as set forth in the following claims.

What is claimed is:

1. A flat panel sound radiator assembly comprising:

a frame;

a radiating panel resting within the frame, the radiating panel having a backing side and facing side;

at least one acoustic transducer operatively connected to the backing side of the radiating panel; and an acoustic facing concealing the facing side of the radiating panel and the acoustic facing being substantially visually indistinguishable from surrounding ceiling panel facing sides, wherein the acoustical facing is selected from the group consisting of woven and pressed materials with sufficiently low acoustic mass and internal damping whereby the facing enables efficient sound transfer, and the acoustical facing is substantially transparent to sound and is applied directly to the radiating panel.

2. The flat panel sound radiator assembly of claim 1, further including a bridge element attached to the frame.

3. The flat panel sound radiator assembly of claim 1, wherein the acoustical facing has a high airflow resistance.

4. The flat panel sound radiator assembly of claim 1, wherein the acoustical facing is selected from the group consisting of woven glass fiber, woven cotton, image paper, and image polypropylene.

5. The flat panel sound radiator assembly of claim 1, wherein the acoustical facing comprises a pigmented coating applied directly to the facing side of the radiating panel.

6. The flat panel sound radiator assembly of claim 1, wherein the acoustical facing comprises indentations applied to the facing side of the radiating panel to emulate the surrounding ceiling panels.

7. The flat panel sound radiator assembly of claim 1, wherein the acoustical facing is fastened to the frame and spans an opening defined by the frame.

8. The flat panel sound radiator assembly of claim 1, further comprising an extrusion attached to the frame.

9. The flat panel sound radiator assembly of claim 1, wherein the assembly is modular in design.

10. The flat panel sound radiator assembly of claim 1, wherein the assembly is in the same plane as the surrounding ceiling tiles.

11. The flat panel sound radiator assembly of claim 1, further comprising facing supports attached to the frame and the acoustical facing.

12. The flat panel sound radiator assembly of claim 1, wherein the assembly rests within a support grid of a suspended ceiling.

13. A flat panel sound radiator assembly comprising:

a peripheral frame;

a radiating panel resting within the frame, the radiating panel having a backing side and facing side;

at least one acoustic transducer operatively connected to the backing side of the radiating panel; and an acoustic facing concealing the facing side of the radiating panel and the acoustic facing being substantially visually indistinguishable from surrounding ceiling panel facing sides, wherein the acoustical facing is fastened to the frame and spans an opening defined by the frame, and the acoustical facing is substantially transparent to sound.

14. The flat panel sound radiator assembly of claim 13, further including a bridge element attached to the frame.

15. The flat panel sound radiator assembly of claim 13, wherein the acoustical facing has a high airflow resistance.

16. The flat panel sound radiator assembly of claim 13, wherein the acoustical facing is selected from the group consisting of woven and pressed materials with sufficiently low acoustic mass and internal damping whereby the facing enables efficient sound transfer.

17. The flat panel sound radiator assembly of claim 13, wherein the acoustical facing is selected from the group consisting of woven glass fiber, woven cotton, image paper, and image polypropylene.

18. The flat panel sound radiator assembly of claim 13, wherein the acoustical facing comprises a pigmented coating applied directly to the facing side of the radiating panel.

19. The flat panel sound radiator assembly of claim 13, wherein the acoustical facing comprises indentations applied to the facing side of the radiating panel to emulate the surrounding ceiling panels.

20. The flat panel sound radiator assembly of claim 13, further comprising an extrusion attached to the frame.

21. The flat panel sound radiator assembly of claim 13, wherein the assembly is modular in design.

22. The flat panel sound radiator assembly of claim 13, wherein the assembly is in the same plane as the surrounding ceiling tiles.

23. The flat panel sound radiator assembly of claim 13, further comprising facing supports attached to the frame and the acoustical facing.

24. The flat panel sound radiator assembly of claim 13, wherein the assembly rests within a support grid of a suspended ceiling.

* * * * *